United States Patent [19]

Ura et al.

[11] Patent Number: 4,651,533

[45] Date of Patent: Mar. 24, 1987

[54] PROTECTION-DRIVING METHOD OF A FEEDWATER HEATER AND THE DEVICE THEREOF

[75] Inventors: Katsumi Ura, Kitaibaraki; Kenji Sakka, Hitachi; Yosimi Kouno, Takahagi; Taiji Inui, Hitachi, all of Japan

[73] Assignee: Hitachi, Ltd., Tokyo, Japan

[21] Appl. No.: 837,346

[22] Filed: Mar. 7, 1986

[30] Foreign Application Priority Data

Mar. 8, 1985 [JP] Japan ..... 60-44832

[51] Int. Cl.[4] ..... F01K 7/34

[52] U.S. Cl. ..... 60/678; 60/646; 60/657

[58] Field of Search ..... 60/678, 646, 657

[56] References Cited

U.S. PATENT DOCUMENTS 4,003,205 1/1977 Matsumura ..... 60/678 X 4,583,369 4/1986 Shapiro ..... 60/646 X

*Primary Examiner*—Allen M. Ostrager

*Attorney, Agent, or Firm*—Antonelli, Terry & Wands

[57] ABSTRACT

A steam turbine power plant having a feedwater heater, a boiler, a steam turbine driven by steam generated in the boiler, and a condenser for condensing steam exhausted from the steam turbine. An extracting steam pipe is provided which includes a control valve for extracting a steam from the steam turbine to the feedwater heater, with a controller being provided for controlling an amount of the extracting steam in order to control a feedwater temperature flowing through the feedwater heater at an adequate range when the plant is starting or stopping. By controlling the feedwater temperature, a thermal stress generated in the feedwater heater is reduced to below an allowable value so that it is possible to increase the working or service life of the feedwater heater and improve the reliability of the steam turbine plant while reducing the maintenance costs thereof.

16 Claims, 11 Drawing Figures

NUMERICAL VALUES DENOTE REMAINING WORKING LIFE % PER ONE CYCLE
A REMAINING WORKING LIFE (%) AT HALT. (600 MW-CLASS HEMISPHERE WATER CHAMBER)

PROTECTION-DRIVING METHOD OF A FEEDWATER HEATER AND THE DEVICE THEREOF

BACKGROUND OF THE INVENTION

The present invention relates to a steam turbine plant and, more particularly, to a control method and apparatus for operating a feedwater heater of a steam turbine plant which enables an increase in a useful service life of the feedwater heater of the steam turbine plant. Steam turbine power plants are widely used for medium loads which require frequent starts and shutdowns such as a daily start and shutdown operation. With this type of operation of power plants, a wall member of a water chamber in a feedwater heater, especially in a high-pressure feedwater heater, is subjected to an abrupt increase or decrease in temperature caused by a sharp of steep and large load change required during starting or shutdown operations of the steam turbine plant. Consequently, a considerable thermal stress occurs at least partially in the wall member of the water chamber in the feedwater heater, and a repetition of the subjecting of the wall member to the large thermal stresses substantially reduces the life span of the metal of the wall forming the water chamber in the feedwater heater, thereby resulting in a premature damaging of the feedwater heater.

If the wall of the water chamber is made thicker in proportion to the higher pressure necessary for applying a super-critical pressure in a steam turbine power plant, larger thermal stresses are caused during a starting or stopping operation of the steam turbine power plant, with the thermal stresses being extreme and resulting in a damaging of the high pressure feedwater heater.

In, for example, Japanese Patent Laid Open Application No. 1905007/1984, a steam turbine power plant is proposed having a steam generator and a warming or heating pipe means for connecting a high pressure feedwater heater and a steam generator for warming the high pressure feedwater heater prior to a starting and stopping or shutdown of the steam turbine plant, so as to reduce the thermal stress on the high pressure feedwater heater thereby increasing the service life of the feedwater heater.

A disadvantage of the above proposed construction resides in the fact that it is necessary to provide a steam generator and a warming or heating pipe means for generating the high temperature steam and for introducing the steam in order to heat or warm the high pressure feedwater heater whenever the plant is started and stopped. Consequently, the construction of the above proposed steam turbine plant is considerably large and extremely complicated.

The aim underlying the present invention essentially resides in providing a steam turbine power plant with a feedwater heater, which power plant includes means for enabling a temperature control of the feedwater heater without an additional steam generator and/or warming pipe means and which seeks to increase the service life of the feedwater heater.

In accordance with advantageous features of the present invention, thermal stress in the feedwater heater is reduced at an adequate range during operation of the starting and stopping or shutdown of the steam turbine plant in order to prevent damage or consumption of the feedwater heater thereby increasing the service life thereof.

Additionally, in accordance with the present invention, the reliability of the feedwater heater of the steam turbine plant may be significantly increased.

In accordance with the present invention, a steam turbine plant is provided which includes a boiler, a steam turbine, having at least one steam extracting pipe means, and a feedwater heater means connected with the steam extracting pipe means and disposed in the feedwater system of the steam turbine plant. Means are provided for regulating an extracting steam flow rate, with the regulating or control means being adapted to control the steam flowing into the feedwater heater at a suitable steam condition when the steam turbine plant is operating for a starting and shutdown operation.

By virtue of the features of the present invention, it is possible to increase the service or consumption life of the feedwater heater, and also improve the reliability of the steam turbine plant.

DETAILED DESCRIPTION

Figure 1:
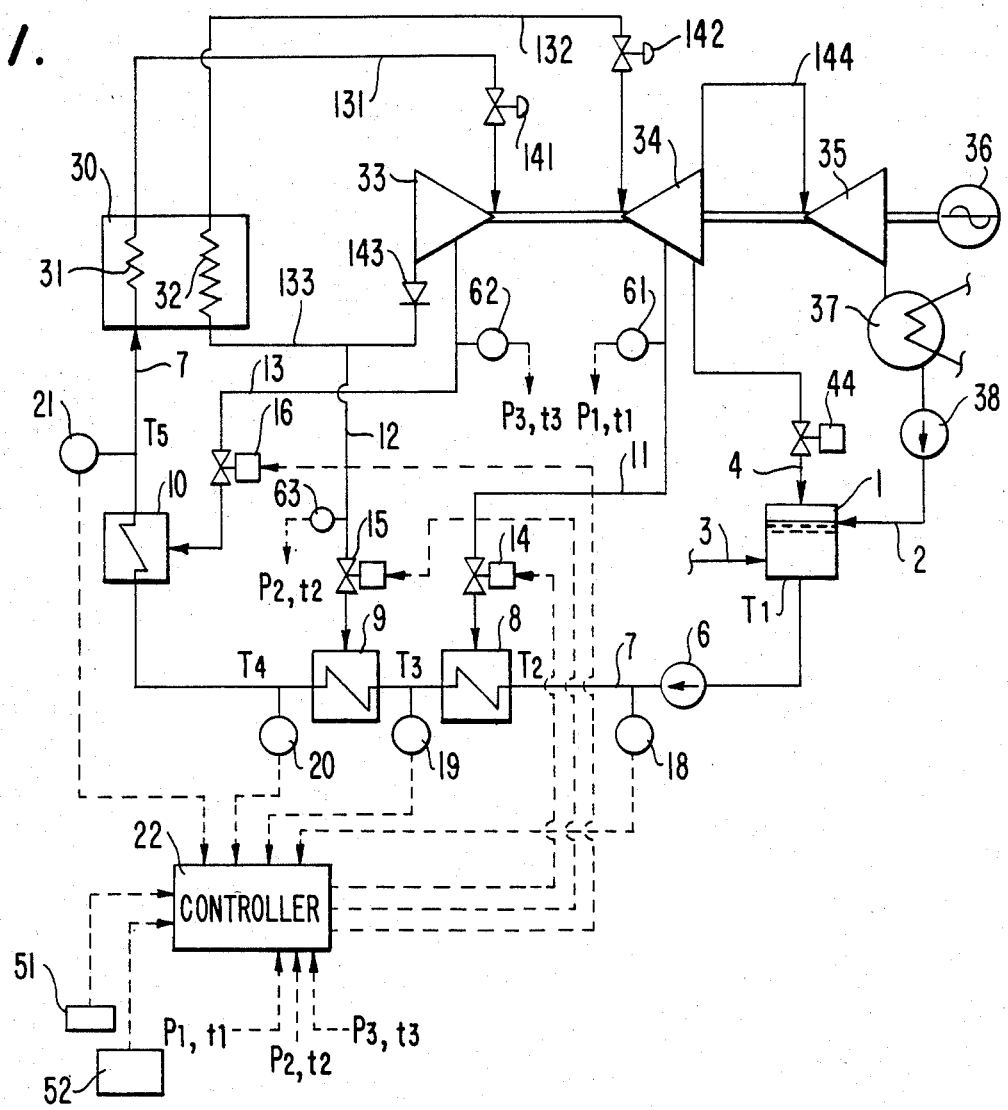
FIG. 1 is a schematic view of a reheat steam turbine power plant having a feedwater heater with a steam extracting pipe constructed in accordance with the present invention.

Referring now to the drawings wherein like reference numerals are used throughout the various views to designate like parts and, more particularly, to FIG. 1, according to this figure, a reheat steam power plant includes a boiler 30, provided with a superheater 31 and a reheater 32 therein. A main steam pipe 131, having a control valve therein, connects the outlet of the superheater 31 with an inlet of the high pressure turbine 33. Main steam, generated in the superheater 31, flows in the high pressure turbine 33 through the main steam pipe 131 for driving a load 36. A cold reheat pipe 133, having a check valve 143 therein, connects the outlet of the high pressure turbine 31 with an inlet of the first reheater 32. A hot reheat pipe 132, having a reheat control valve 142 therein, connects the outlet of the reheater 32 with the inlet of the intermediate pressure turbine 34. Reheat steam, generated in the reheater 32, flows into the intermediate pressure turbine 34 through the hot reheat pipe 132 for driving the load 36. The steam passing from the intermediate pressure turbine 34 flows into the low pressure turbine 35 through a pipe 144 for driving the load 36. The steam passing from the low pressure turbine 35 is exhausted or supplied into a condenser 34 and then the steam is condensed into a liquid condensate. The liquid condensate, stored in the condenser 37, is fed to a deaerator 1 by a condensing pump 38 through a low pressure condensate pipe 2 having a low pressure feedwater heater.

The liquid condensate, deaerated in the deaerator 1, is fed to the boiler 30 by a pumping action of a feedwater pump 6 and a high pressure condensate pipe 7 is provided with a third high pressure feedwater heater 8, a second high pressure feed water heater 9, and a first high pressure feedwater heater 10. A first high pressure steam extraction pipe 13 is connected at a half or mid section of the high pressure steam turbine 33 of the first high pressure feedwater heater 10, and a first extraction control valve 16, provided in the high pressure steam extraction pipe 13, controls a rate of flow of the extraction steam from the high pressure steam turbine 33 for heating or cooling the first high pressure feedwater heater 10.

In a similar manner, a second high pressure steam extraction pipe 12, having a second extraction control valve 15, connects the cold reheat pipe 132 with the second high pressure feedwater heater 9. An intermediate pressure steam extraction pipe 11, having a third extraction control valve 14, is connected at a half or mid portion of the intermediate pressure steam turbine 34 and the high pressure feedwater 8. A low pressure steam extraction pipe 4, having a control valve 44, is connected at the half or mid portion of the intermediate pressure steam turbine 34 and the deaerator 1 for deaerating the condensed water. An auxiliary steam pipe 3 is connected to the deaerator 1 for supplying an auxiliary steam into the deaerator 1. Temperature dectors 18, 19 are provided in the high pressure feedwater pipe 7 and are located in an area of the inlet of the water chamber side and outlet water chamber side of the third high pressure feedwater heater 8 for respectively detecting an inlet feedwater temperature $T_2$ and an outlet feedwater temperature $T_3$, respectively.

Temperature detectors of sensors 20, 21 are provided in the high pressure feedwater pipe 7 and are disposed within an area of the outlet water chamber sides of the second high pressure feedwater heater 9 and the first feedwater heater 10, respectively, for detecting outlet feedwater temperature $T_4$ and $T_5$. The temperature detectors or sensors 19, 20 respectively work as detectors or sensors for the feedwater temperature at the inlets of the second high pressure feedwater heater 9 and the first high pressure feedwater heater 10. Temperature and pressure detectors 62, 61 are respectively disposed in the high pressure steam extraction pipe 13 and the intermediate pressure steam extraction pipe 11 for detecting the steam conditions extracted from the high pressure steam turbine 33 and the intermediate pressure steam turbine 34. The extraction control valves 14, 15 and 16, disposed in the extraction pipes 11, 12 and 13, are operated as shown most clearly in FIG. 2 by a controller 22, when the steam turbine plant is in a starting operation mode and a stopping or shutdown operation mode.

Figure 2:
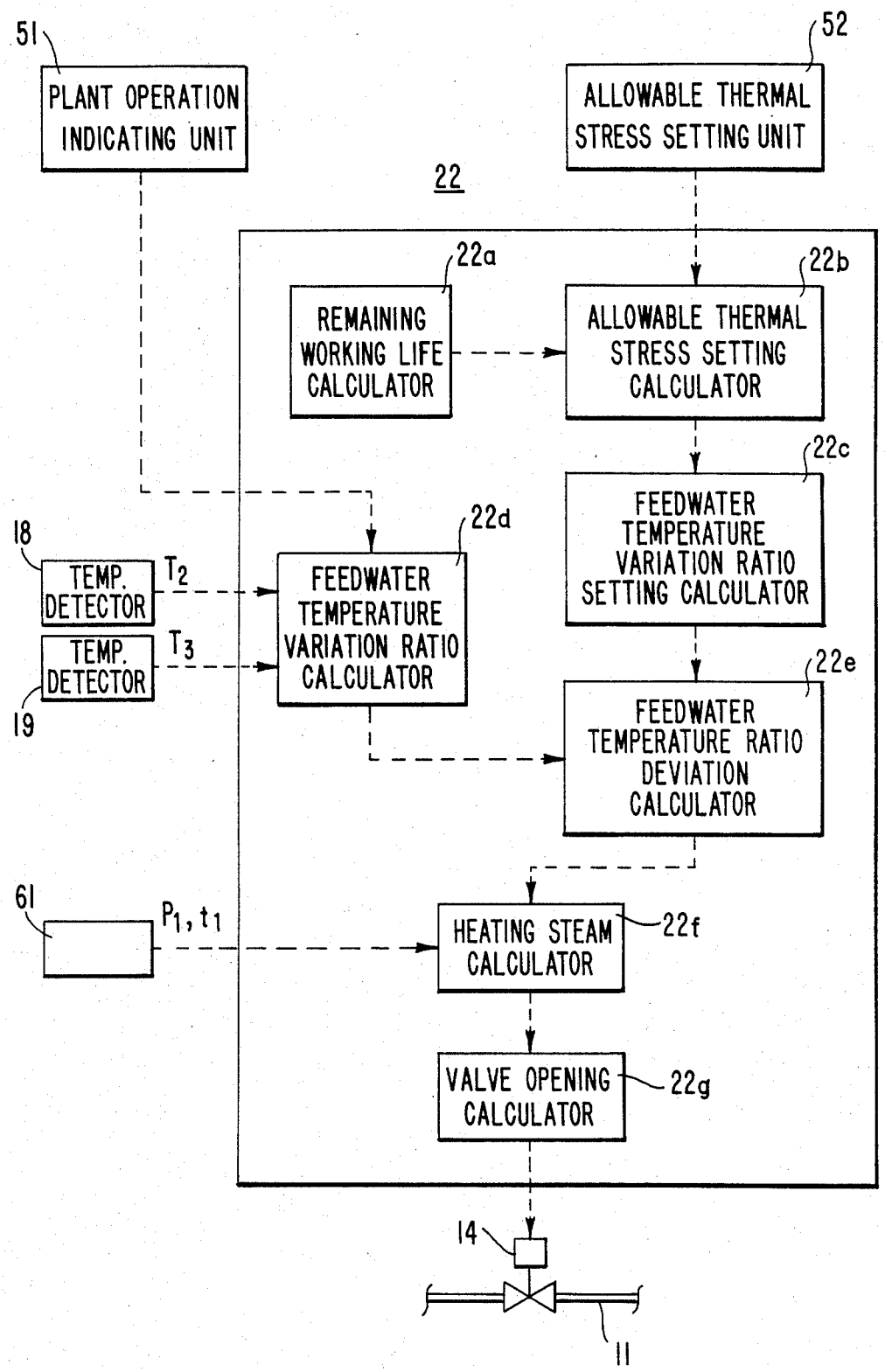
FIG. 2 is a block diagram of a control arrangement for the feedwater heater of the steam turbine power plant of FIG. 1.

As shown in FIG. 2, the controller 22 includes a remaining working or service life calculator **22*a* for computing a remaining working or service life of each feedwater heater per cycle from start to stop operational modes of the steam turbine plant. An allowable thermal stress setting calculator 22*b* computes an allowable thermal stress value in dependence upon the specific working or service life consumption based upon an output of the remaining working life calculator 22*a* and an allowable thermal stress setting unit 52 in a water chamber section of the feedwater heater, and a feedwater temperature variation ratio setting calculator 22*c* sets the temperature variation ratio for maintaining the working life consumption at a level less than a restrainable value in accordance with a plant operation signal from a plant operation indicating unit 51**.

Moreover, the controller 22 provides a feedwater temperature variation ratio calculator **22*d* for calculating an actual rate of the feedwater temperature variation between an outlet feedwater temperature and an inlet feedwater temperature of each high pressure feedwater heater based on the detecting signals from the feedwater temperature detectors 18, 19, 20 and 21. A feedwater temperature ratio deviation calculator 22*e* calculates a deviation between the setting value of the feedwater temperature variation rate computed in the calculator 22*c* and the actual value of the feedwater temperature variation rate computed in the calculator 22*d*. A heating steam calculator 22*f* calculates an amount of heating steam or a flow rate of heating steam introduced into the high pressure feedwater heater in dependence upon the deviation value of the feedwater temperature variation and a temperature and pressure value detected or sensed from a temperature and pressure detector 61, 62, 63 provided in each of the steam extraction pipes 11, 12, and 13. A valve opening calculator 22*g* calculates an opening degree of each of the extraction control valves 14, 15 and 16 in response to the output of the calculator 22*f*. That is, the controller 22 receives the input signals from the temperature detectors 18, 19, 20, and 21 detecting the feedwater temperature at the inlet and outlet of the respective high pressure feedwater heaters 8, 9 and 10, and the input signal of a plant starting or stopping from a plant operation indicating unit 51 as well as another input signal of an allowable thermal stress setting value in the water chamber sections of respective high pressure feedwater heaters from the allowable thermal stress setting unit 52. Based on the above noted input signals, a feedwater temperature variation value for enabling a limiting of the thermal stress generated in the feedwater heater when the plant is starting or stopping is immediately calculated, and an amount of extracted steam, having a predetermined temperature and pressure which is lead or supplied as heated steam through the extracting pipe, is calculated to correspond to the real feedwater temperature of the calculated feedwater temperature variation value. Then, output signal for controlling an opening degree of the extracting control valves 14, 15, and 16** are calculated to correspond to the calculated values of the extracting steam.

A feedwater heater control system of a reheat steam turbine power plant described above operates in the following manner.

After an ignition of the boiler 30, the amount of feedwater corresponding to the minimum discharge of the boiler 30 is supplied, by the feedwater pump 6, from the deaerator 1 to the superheater 31 in the boiler 30 to the feedwater pipe 7. At this time, an interior of the deaerator 1 is at a vacuum or in a low pressure state of about 0.3 atm. The temperature of the stored water is about 60° C. to 107° C. This means that the condensed water, supplied from the condenser 37, to the deaerator 1 through the condensing pipe 2 is heated to about 107° C. by the heated steam supplied through the auxiliary steam pipe 3. The feedwater pumped or boosted by the feedwater pump 6, is supplied to the boiler 30 sequentially through the third high-pressure feedwater heater 8, the second high-pressure feedwater heater 9, and the first high-pressure feedwater heater 10 disposed in the high pressure feedwater pipe 7. However, since the turbines 34, 35 and 36 do not start at the boiler-starting stage when the turbine plant starts, there is no heated steam of the first to third high pressure feedwater heaters 8–10 and, thus, the extracting control valves 14–16, provided at the respective extraction pipes 11–13, are all closed.

Figure 4A:
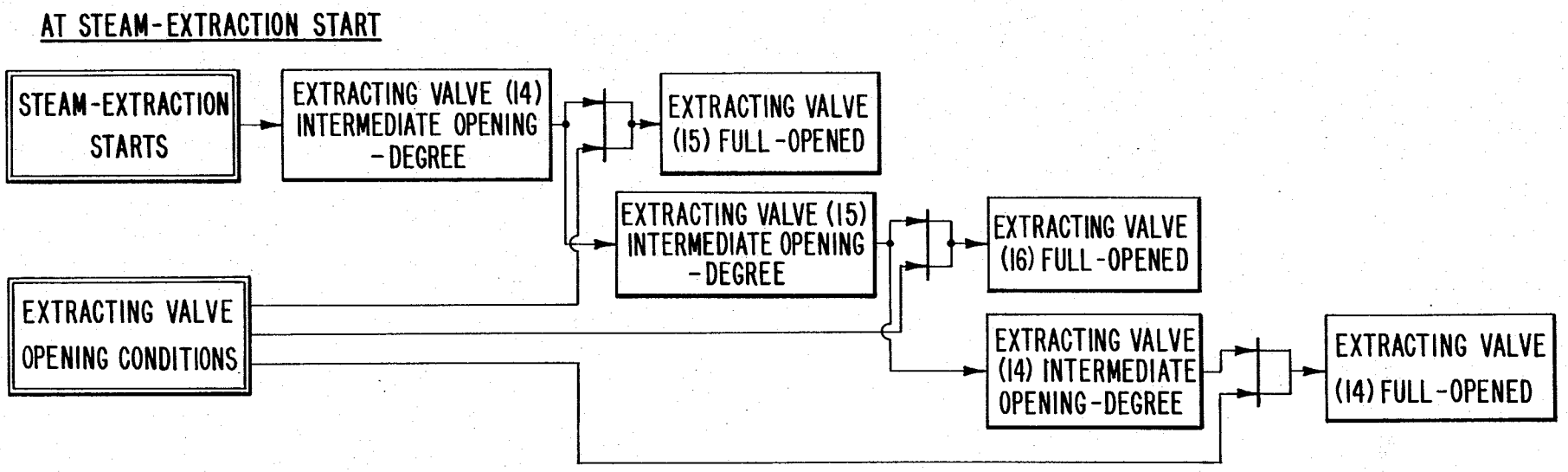
FIG. 4A is a block diagram depicting an operation for opening extracting valves in the steam extracting pipe during a starting operation of the power plant of FIG. 1.

In accordance with the operating process shown in FIG. 4A, after a starting of the turbine, the third extracting control valve 14 is opened to a predetermined degree after the turbine load attains a ratio of about 5% and the third this pressure feedwater 8 is put into service. Next, the second extracting valve 15 is opened to a predetermined degree and the second high pressure feedwater heater is put into service, and lastly, the first extracting valve 16 is opened to a predetermined degree and the first high pressure feedwater heater 10 is put into service. As apparent from a review of the above described operating process of the present invention, the heaters are sequentially put into service from the low-pressure to the high-pressure.

Figure 4B:
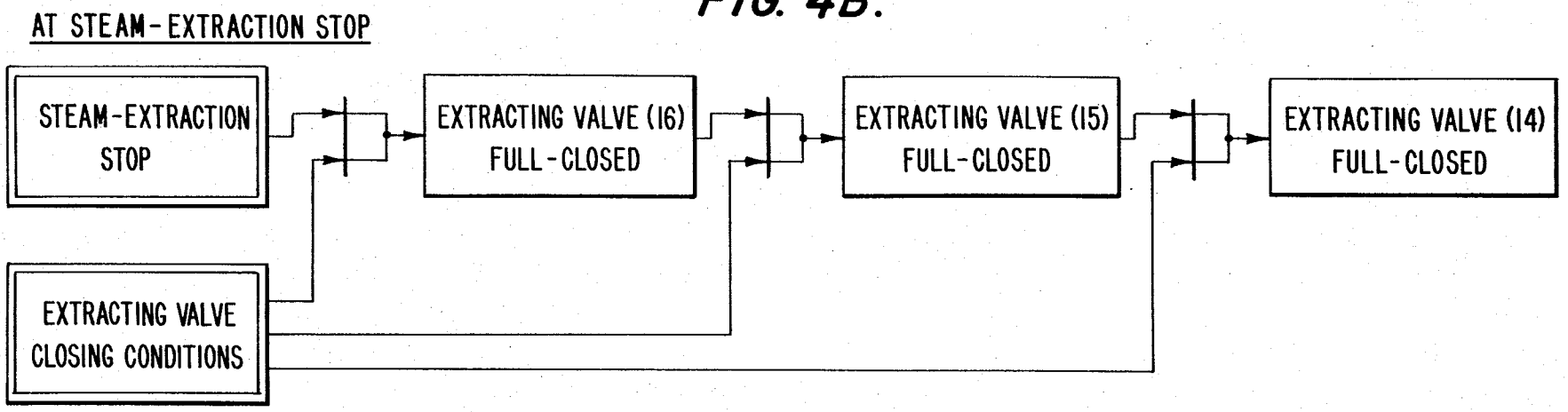
FIG. 4B is a block diagram depicting an operation for closing the extracting valves in the steam extracting pipe during a stopping or shutdown operation of the power plant of FIG. 1.
Figure 5A:
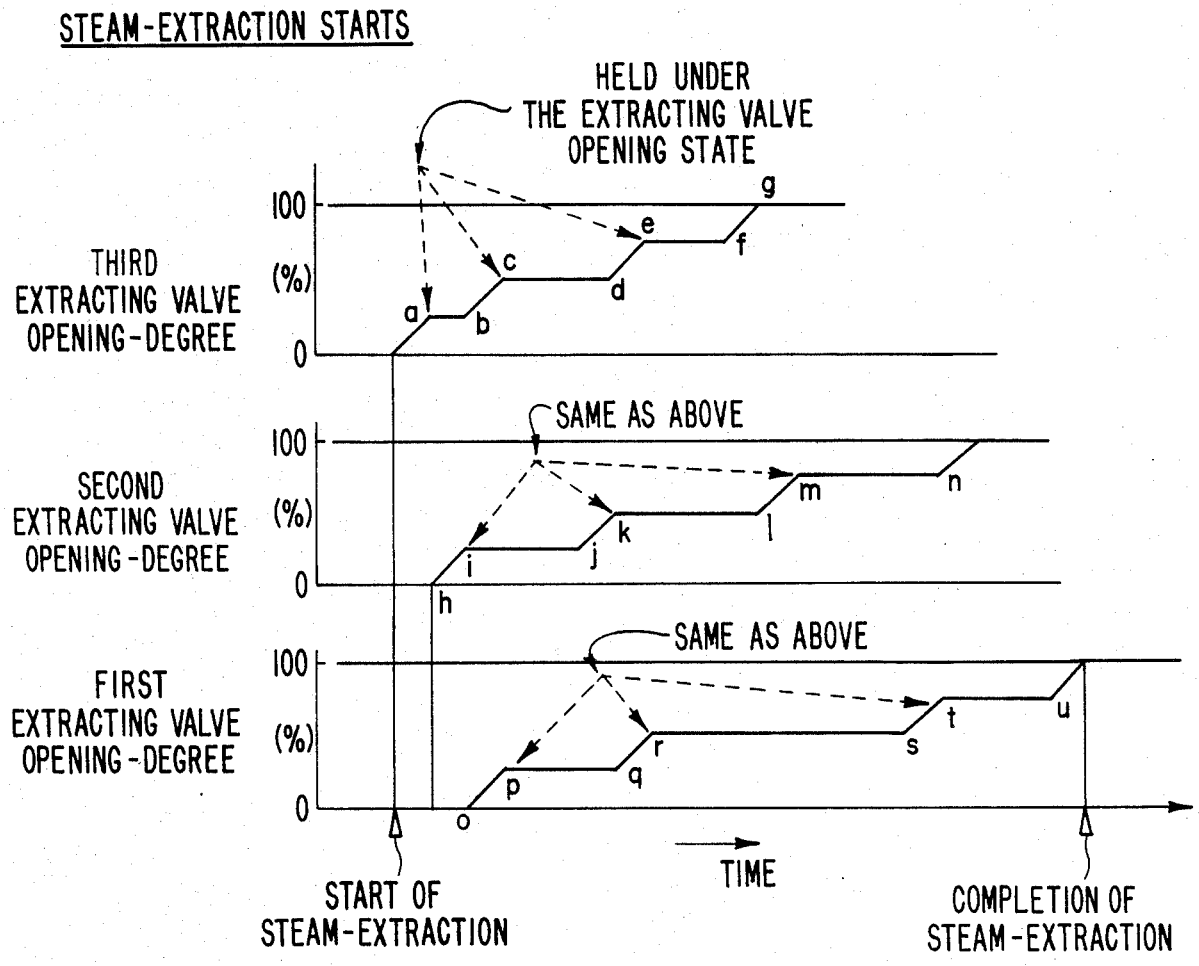
FIG. 5A is a graphical illustration of a relationship between a degree of opening of the steam extracting valves and the operation time during a starting operation of the turbine power plant of FIG. 1.
Figure 5B:
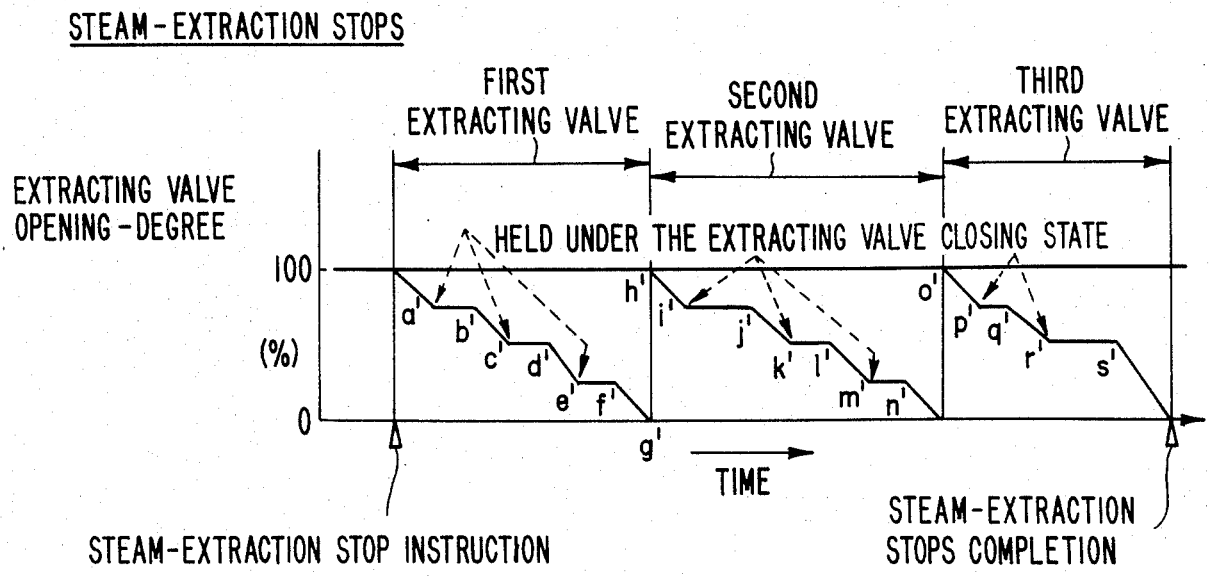
FIG. 5B is a graphical illustration of a relationship between a degree of opening of the steam extracting valves and the operation time during a stopping or shutdown operation of the turbine power plant of FIG. 1.

Moreover, as shown in FIG. 5A, during the opening operation of the second extracting valve 15, the degree of opening of the third extracting valve 16 is held or maintained for a predetermined time and, during the opening operation of the first extracting valve 14, the degree of opening of the third and the second extracting valves 15, 16 are held or maintained for a predetermined time. Upon a stopping or shutdown of the plant, as shown in FIGS. 4B and 5B, the process is reversed. After lowering the load to 20%, the first extracting valve 16 is closed to a certain or predetermined degree and the first high pressure feedwater heater 10 is stopped. Subsequently, the second extracting valve 15 is closed to a certain or predetermined degree and the second high pressure feedwater heater 9 is stopped or shutdown. Lastly, the third extracting valve 14 is closed to a certain or predetermined degree and the third high pressure feedwater heater 8 is stopped. As shown in FIGS. 4B and 5B, by this process, the heaters are sequentially stopped or shut down from the high pressure sides.

The control system of the high pressure feedwater heater operates in the following manner.

Figure 3:
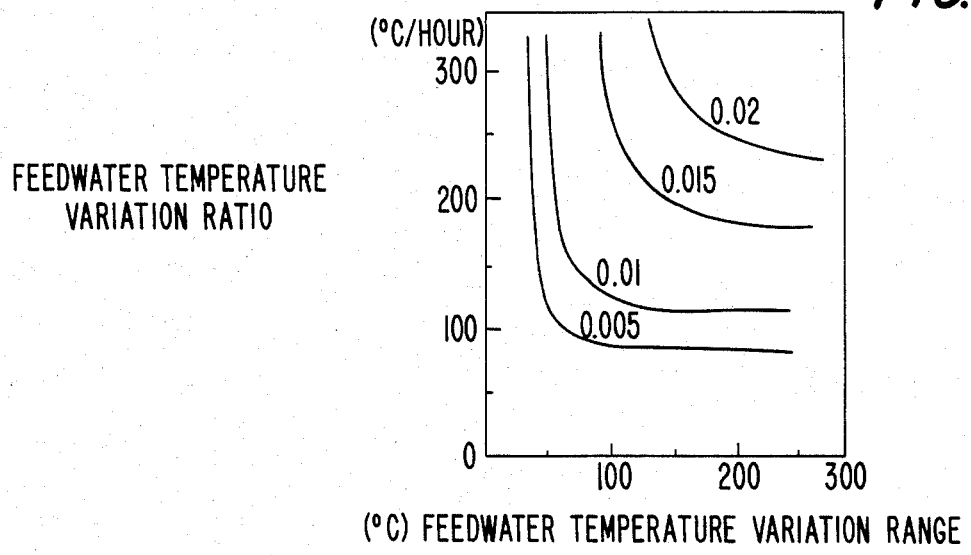
FIG. 3 is a graphical illustration of a relationship between a consumption or service life of a feedwater heater per cycle and a temperature variation of a feedwater of the steam turbine power plant of FIG. 1.

In order to simplify the description of operation, FIG. 2 merely shows the control system of the third high pressure feedwater heater 8. More particularly, in FIG. 2, the controller 22 includes a remaining working or service like calculator **22*a* for computing the remaining working life of the apparatus per cycle from the start to the stop of the water chamber section of the high pressure feedwater heater 8 in dependence upon a relationship between the feedwater temperature variation ratio and feedwater temperature variation range as shown in FIG. 3 and for memorizing its data and an allowable thermal stress setting calculator 22*b* for computing an allowable thermal stress value by virtue of a device for calculating the remaining working life on the basis of signals from the calculator 22*a* and the allowable thermal stress setting unit 52 in the water chamber section of the feedwater heater 8. Furthermore, the controller 22 includes an arrangement which can further provide a feedwater temperature variation ratio setting calculator 22*c* for setting the rate at which the working or service like is used to as low a value as is practicable, that is, a value less than or lower than a restrainable feedwater temperature variation ratio of, for example, 300°/Hour on the basis of the allowable thermal stress value from the setting calculator 22*b* and at once for performing the operation in accordance with the plant starting or plant stopping signal from the plant operation indicating unit 51. The feedwater temperature variation ratio calculator 22*d* computes an actual ratio of feedwater temperature variation on the basis of the detection signals from the temperature detectors 18, 19, respectively detecting an inlet feedwater temperature $T_2$ and an outlet feedwater temperature $T_3$ of the third feedwater heater 8 disposed in the high pressure feedwater pipe 7. A feedwater temperature ratio deviation calculator 22*e* computes a deviation between the setting value of the feedwater temperature variation ratio calculated in the setting calculator 22*c* and the actual value of the feedwater temperature variation ratio calculated in the calculator 22*d*. A heating steam calculator 22*f* of the controller 22 computes the flow rate of the heated steam or an amount of heated steam corresponding to the deviation value of the feedwater temperature variation ratio output from the calculator 22*e* in dependence upon the input signal from a temperature and pressure detector 61 provided in the extraction pipe 11. A valve-opening calculator 22*g* computes a control signal for controlling an opening degree of the extraction valve 14 in response to the output of the calculator 22*f*. If the respective high pressure feedwater heaters 8–10 are driven when starting or stopping the steam turbine plant, the controller 22** holds the feedwater temperature variation ratio to a predetermined value so as to limit thermal stress in the water chamber of said feedwater heater at a value under an allowable thermal stress value and improves the reliability of the feedwater heater.

Accordingly, when starting the steam turbine plant, as shown in FIG. 5A, by operation of the controller 22, the third extracting valve 14 slowly opens until a predetermined or certain degree of opening is provided so as to supply the third high pressure feedwater heater 8 with heated steam at a certain turbine load of, for example, a 5% load, and thus the third high pressure feedwater heater 8 is placed in service. Next, the second extracting valve 15 slowly opens to a certain or predetermined degree of opening so as to supply the second high pressure feedwater heater 9 with heated steam; therefore, the second high pressure feedwater heater 9 is placed in service. Lastly, the first extracting valve 16 slowly opens to a certain degree of opening so as to supply the first high pressure feedwater heater 10 with heated steam and thus, the first high pressure feedwater heater 10 is placed into service. At this stage, respective extracting valves 14–16 are all in a minimal opening state; however, by leading or supplying heated steam to the respective feedwater heaters 8–10, the feedwater flowing down through the respective feedwater heaters 8–10 are slightly heated so that the temperature of the feedwater rises.

Subsequently, the temperature detectors 18–20, provided at outlets and inlets of the respective feedwater heaters 8–10, detect or sense respective feedwater temperatures $T_2$–$T_5$ when the extracting valves 14–16 are sequentially being opened. The feedwater temperature variation ratio calculator **22*d* of the controller 22 computes an actual ratio of feedwater temperature rise on the basis of the detected or sensed values and the feedwater temperature ratio deviation calculator 22*e*, calculated in the setting calculator 22*c***, compares it with a predetermined setting value in accordance with an allowable thermal stress.

Consequently, if the actually measured feedwater temperature variation ratio is less than the setting value, as the opening operation conditions for the extraction valves 14–16, the valve opening operation signal is outputted from the valve opening calculator **22*g* in the controller 22 to the extracting valves 14–16 so as to operate the valves 14–16 in a direction of increasing the degree of opening thereof. On the otherhand, if the actual feedwater temperature variation ratio in either of the water chambers of the high pressure feedwater heaters is greater than the setting value, this means that the opening condition of the extracting valves 14–16 for supplying the corresponding feedwater with extracted steam has not been established and that the extracting valves 14–16** are held at their present degree of opening.

If the above noted controls are continued until the feedwater temperature in each feedwater heater rises to a predetermined value, that is, the heater start is completed, the temperature variation ratio in each water chamber of the feedwater heater is computed and, as a result, thermal stress can be controlled at a lower value than the setting value so that the working or service life can be prolonged.

Figure 6:
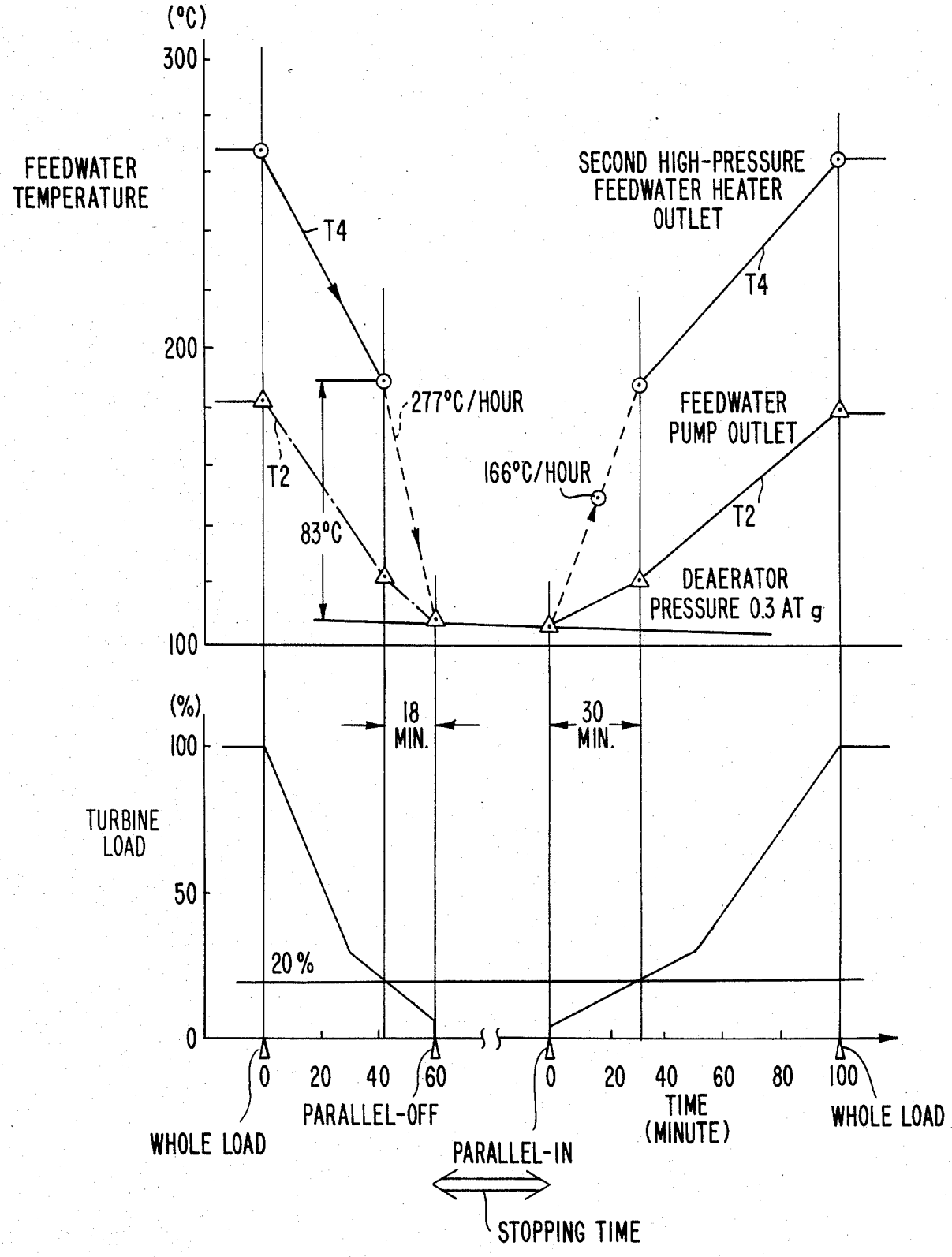
FIG. 6 is a graphical illustration of a relationship between a load of the turbine plant and a temperature of the feedwater during stopping or shutdown and restarting operations of the turbine power plant of FIG. 1 after the power plant has been shutdown overnight.

In FIG. 6, representing the relationship between a turbine load and feedwater temperature when restarting a turbine plant, a feedwater pump outlet temperature $T_2$ represents the inlet temperature for the third high pressure feedwater heater, and the second high pressure feedwater outlet temperature $T_4$ represents the inlet temperature of the first high pressure feedwater heater. As shown in FIG. 6, since the controller 22 serves to control respective extracting valves 14–16, the feedwater temperature variation ratios in respective high pressure feedwater heaters 8–10 are reduced to within an allowable value of 300° C./Hour, for example, 277° C. when stopping and 166° C. when starting.

Figure 7:
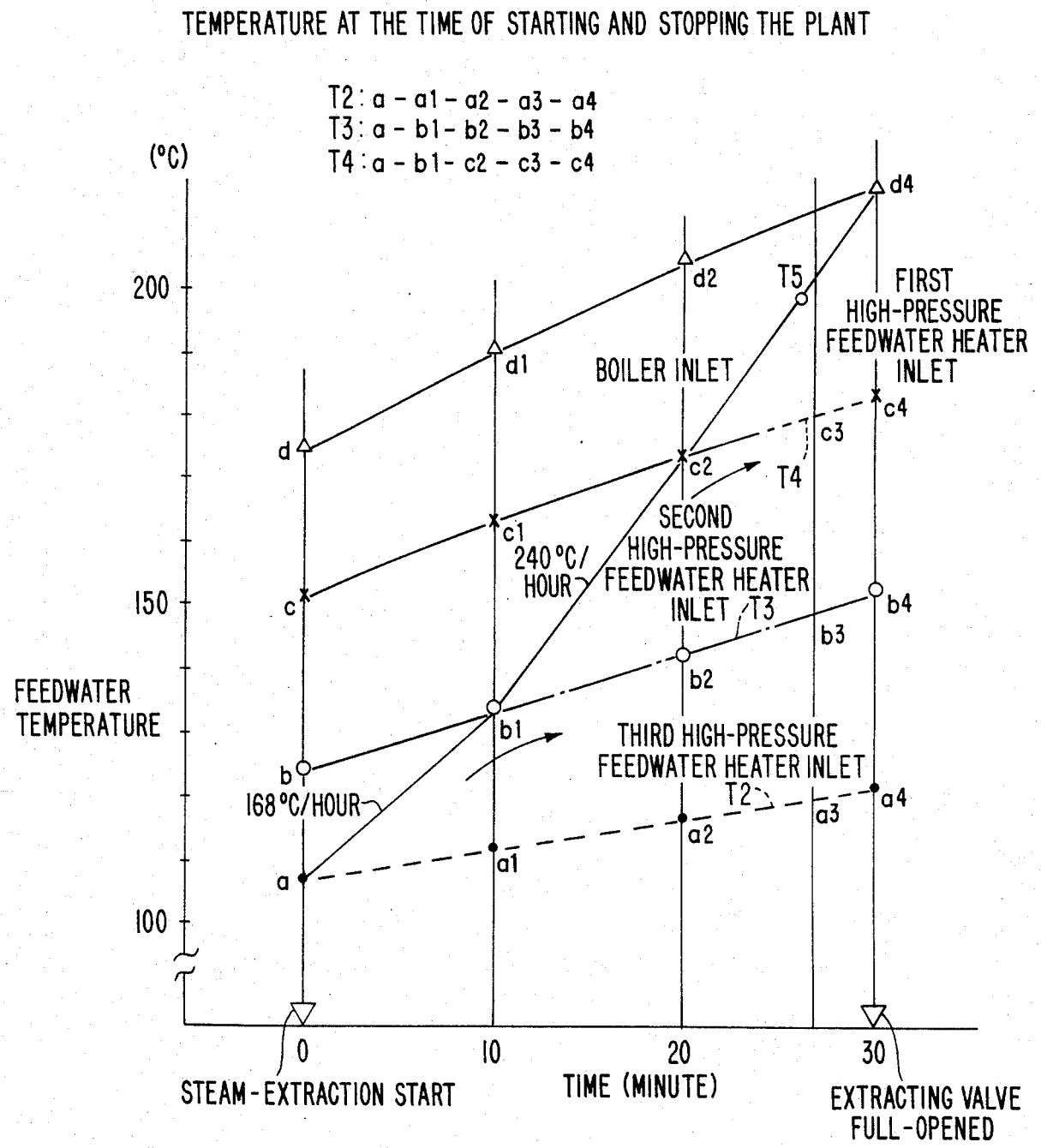
FIG. 7 is a graphical illustration of a relationship of a variation between the feedwater temperature at the inlets and outlets of the respective high pressure feedwater heaters during a starting operation of the power plant of FIG. 1.

FIG. 7 provides an example of the condition of the feedwater temperature variation at the inlets and outlets of the respective high pressure feedwater heaters when starting the plant and, more particularly, as apparent from FIG. 7, the feedwater temperature variation ratio is reduced under the allowable value of 300° C./Hour to a maximum of 168° C./Hour at the inlet of the second high pressure feedwater heater and a maximum of 240° C./Hour at the inlet of the first high pressure feedwater heater.

By virtue of the above noted features of the present invention, it is possible to achieve a number of advantageous effects. More particularly, by reducing an amount of thermal stress generated in a water chamber of the high pressure feedwater heater when the plant is starting or stopping, it is possible to prevent the feedwater heater from being damaged and improve the reliability thereof thereby significantly reducing the overall maintenance costs. Moreover, the working life of the feedwater heater can be greatly prolonged as shown most clearly in Table 1 hereinbelow which provides an example of a calculation of an extra supercritical pressure steam power plant having a capacity of 1,000 MW.

TABLE 1

Example of the high-pressure heater working life

| | | Working life already used (%) | |
|---|---|---|---|
| | times/20 yrs. | control free system | invention system |
| cold and warm start | 980 | 31 | 15 |
| hot start | 4,600 | 159 | 31 |
| load change | 27,600 | 3 | 3 |
| total | | 193 | 49 |

Additionally, by virtue of the features of the present invention, the feedwater heater warming operation which is a turbine load holding operation and the like is not required in order to reduce the thermal stress generated in the water chamber of the feedwater heater when the plant is starting and stopping and, consequently, the starting time and stopping time of the plant as well as the starting energy is considerably reduced. Moreover, the operation of the plant is simplified thereby improving the overall plant efficiency.

Also, by virtue of the present invention, additional equipment for warming the feedwater heater such as a steam generator generating warming steam is not required thereby also considerably simplifying the structure of the steam power plant.

Figure 8:
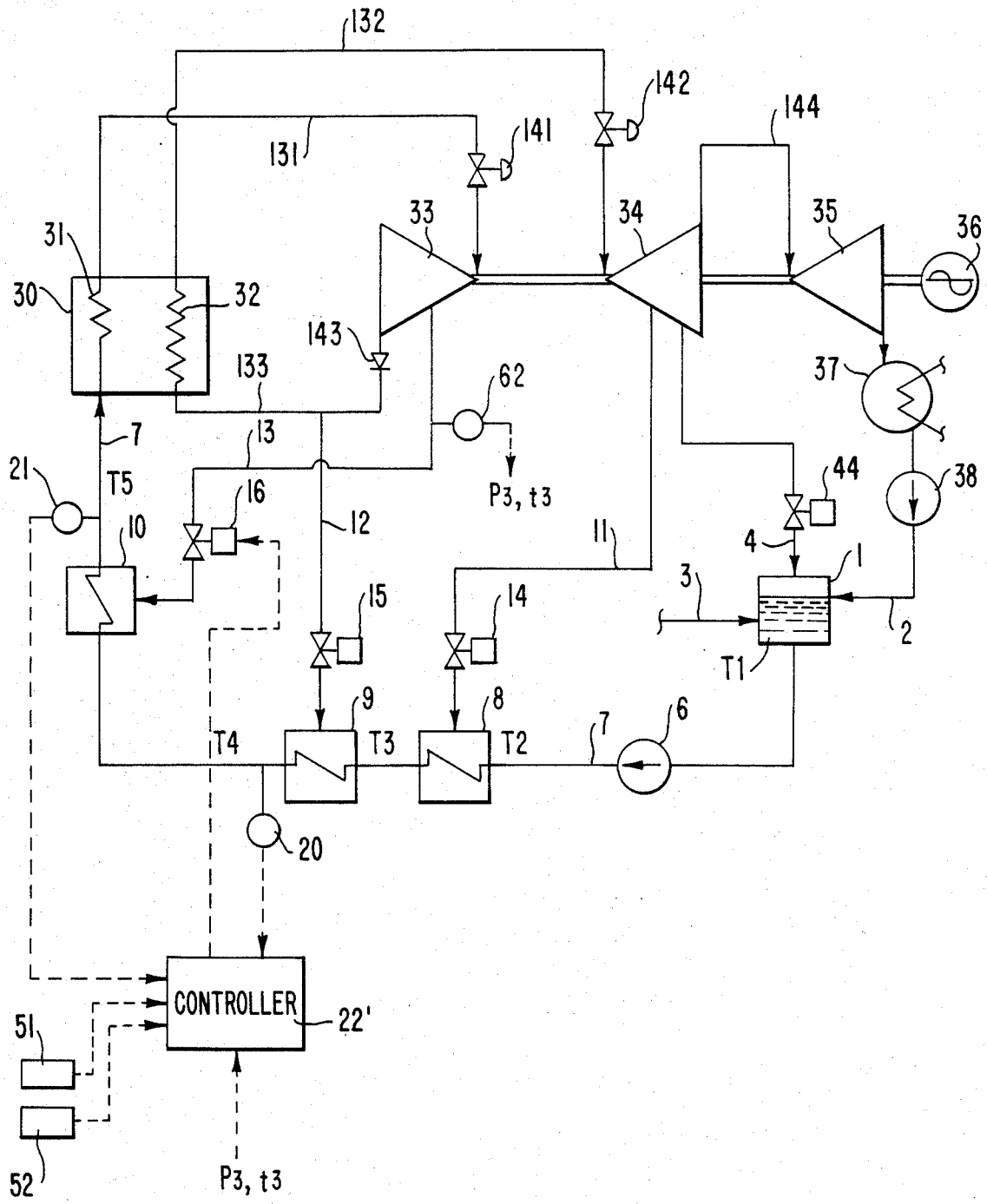
FIG. 8 is a schematic view of another embodiment of a reheat steam turbine power plant having a feedwater heater with a steam extracting pipe constructed in accordance with the present invention.
Figure 9:
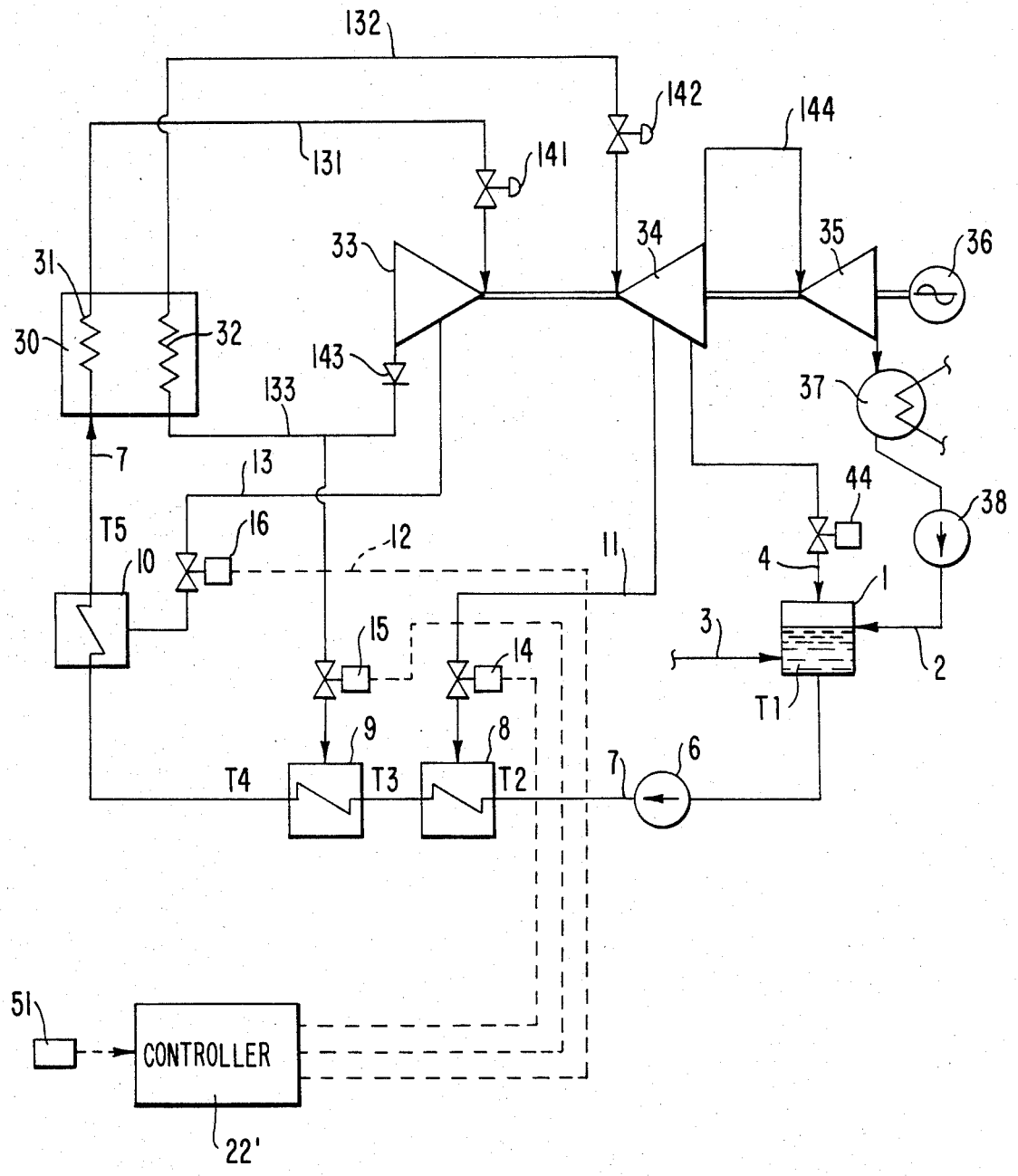
FIG. 9 is a schematic view of another embodiment of a reheat steam turbine power plant having a feedwater heater with a steam extracting pipe constructed in accordance with the present invention.

As shown in FIGS. 8 and 9, reheat steam turbine power plants having a control system of the feedwater heater are provided which differ in some respects from the embodiment described in FIG. 1; however, the embodiments shown in FIGS. 8 and 9 are fundamentally identical with the embodiment shown in FIG. 1 in principle and use. In FIGS. 8 and 9, the first high pressure feedwater heater, located the furtherest downstream from the feedwater system, has the largest temperature variation range at the inlet of the feedwater heater when the plant is stopped. Consequently, the ratio of feedwater temperature variation is large and thus the difference with respect to the first embodiment is to control only the feedwater temperature variation ratio of the first high pressure feedwater heater 10 since the feedwater temperature variation ratios of the second and third high pressure feedwater heater are less than that of the first high pressure feedwater heater.

Accordingly, the above described control system of the feedwater heater of the steam turbine plant is also effective in reducing the working or service life consumption of the feedwater heater so that it is possible to improve the reliability of the steam power plant.

Moreover, the last described embodiment is advantageous in that the arrangement of the control device can be more simplified.

Furthermore, in the embodiment of FIG. 9, a construction is provided wherein a program based on the computation in advance of the ratio of the feedwater temperature variation in every starting mode or of the actually measured data during a test run is provided in the computing section of the controller device 22', and the signal based on the program controls the respective extracting valves. Thus, the above described control system of the feedwater heater of the steam turbine plant is also effective in reducing the consumption or reduction of the working life of the feedwater heater so that it is possible to improve the reliability of the steam power plant.

Additionally, the above described embodiment enables an arrangement of a controller which can be considerably simplified.

As apparent from the above description, the steam turbine power plant of the present invention enables a control of the feedwater temperature for increasing the life span or service life of the feedwater heater with an additional steam generator for warming the feedwater heater thereby improving the reliability of the steam turbine plant and also reducing the maintenance costs thereof.

While we have shown and described several embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A steam turbine plant including at least one feedwater heater means, the steam turbine plant comprising: a boiler means, a steam turbine means driven by steam generated in the boiler means and supplied through a main steam pipe means, a condenser means for condensing the steam exhausted from the steam turbine means, a feedwater pipe means for connecting the condenser means with an upstream side of the boiler means, said at least one feedwater heater means being disposed in the feedwater pipe means, an extracting pipe means disposed between the steam turbine means and the feedwater heater means for introducing an extracting steam, a control valve means disposed in the extracting pipe means for controlling an amount of the extracting steam, means for calculating a feedwater temperature variation in accordance with a predetermined allowable thermal stress of the feedwater heater means, and means for controlling the valve means in accordance with an output of the calculating means.

2. A steam turbine plant as claimed in claim 1, wherein the calculating means comprises feedwater temperature detector means disposed at an inlet and an outlet side of the at least one feedwater heater means, a first calculating means for calculating an actual feedwater temperature variation ratio in accordance with an output of the temperature detector means, a second calculating means for calculating an allowable feedwater temperature variation ratio based on the predetermined allowable thermal stress of the feedwater heater means, and a third calculating means for calculating a deviation value between outputs of the second calculating means and the third calculating means as an operational signal for the means for controlling the valve means.

3. A steam turbine plant as claimed in claim 2, wherein the valve controlling means comprises a steam detector means disposed in the extracting pipe means for detecting at least one of a temperature and a pressure of the extracting steam flowing through the extracting pipe means, a fourth calculating means for calculating an amount of the extracting steam to introduce into the feedwater heater means in accordance with the outputs of the third calculating means and the steam detector means.

4. A steam turbine plant as claimed in claim 2, wherein the second calculating means comprises a first allowable thermal stress setting means for setting an allowable thermal stress of the feedwater heater means, a remaining working life calculating means for calculating a remaining working life of the feedwater heating means per cycle from the start to stop operation of the steam turbine plant, and a second allowable thermal stress setting means for calculating an allowable thermal stress under a specific remaining working life of the feedwater heater means based on the outputs of the first allowable thermal stress setting means and the remaining working life calculating means, and a temperature variation ratio calculating means for calculating an allowable feedwater temperature variation ratio in accordance with an output of the second allowable thermal stress setting means.

5. A steam turbine plant including at least one feedwater heater means, the steam turbine plant comprising: a boiler means having a superheater and a reheater therein, a high pressure steam turbine means driven by steam generated in the superheater and supplied through a main steam pipe means, an intermediate pressure steam turbine means driven by reheat steam heated in the reheater means and conducted through a hot reheat steam pipe means, a condenser means for condensing a steam exhausted from the intermediate pressure turbine means, a cold reheat steam pipe means connecting an outlet of the high pressure steam turbine means with an inlet of the reheater, a feedwater pipe means for connecting the condenser means with an upstream side of the superheater, the at least one feedwater heater means is disposed in the feedwater heat pipe means, and extracting steam pipe means is disposed between the high pressure steam turbine means and the feedwater heater means for introducing an extracting steam into the feedwater heater means, a control valve means is disposed in the extracting pipe means for controlling an amount of the extracting steam, means are provided for calculating an allowable thermal stress in accordance with a predetermined thermal stress, means are provided for calculating an allowable feedwater temperature variation ratio based upon an output of the allowable thermal stress calculating means, means for calculating an amount of the extracting steam to be introduced into the feedwater heater means, and means for controlling the extracting value in accordance with the output of the amount of the extracting steam calculating means.

6. A steam turbine plant as claimed in claim 5, wherein the allowable thermal stress calculating means comprises means for setting an allowable thermal stress value of the feedwater heater means, means for calculating a remaining working life of the feedwater heater means per cycle from start to stop operations of the steam turbine plant based on an output of the allowable thermal stress setting means, and a means for calculating an allowable thermal stress value under the specific remaining working life of the feedwater heater means in accordance with the output of the remaining working life calculation means.

7. A steam turbine plant as claimed in claim 6, wherein the allowable feedwater temperature variation ratio calculating means comprises a detecting means for detecting a feedwater temperature at an inlet side and an outlet side of the feedwater heater means, means for calculating an actual feedwater temperature variation ratio based on outputs of the feedwater temperature detecting means, means for setting an allowable feedwater variation ratio based on the output of the allowable thermal stress calculating means, and means for calculating a feedwater temperature ratio deviation as an input signal for the extracting steam calculating means in accordance with outputs of the allowable feedwater variation ratio setting means and the actual feedwater temperature variation ratio calculating means.

8. A steam turbine plant as claimed in claim 7, wherein the means for calculating an amount of the extracting steam comprises means for detecting the temperature and pressure of an extracting steam introduced into the feedwater heater means, means for calculating a flow rate of the extracting steam in accordance with outputs of the temperature and pressure of the extracting steam detecting means and the feedwater temperature ratio deviation calculating means.

9. A method of controlling at least one feedwater heater means in a steam turbine plant when the steam turbine plant is starting and stopping, the method comprising the steps of:

calculating an allowable thermal stress of the feedwater heater means, calculating a feedwater temperature variation ratio of the feedwater in accordance with the calculated value of the allowable thermal stress, and controlling a steam extracting valve to regulate an amount of extracting steam introduced into the feedwater heater means from a steam turbine in accordance with the calculated value of the feedwater temperature variation ratio.

10. A method of controlling a feedwater heater means as claimed in claim 9, wherein the step of calculating the allowable stress of the feedwater heater means is followed by setting an allowable thermal stress value of a water chamber section of the feedwater heater means, calculating the remaining working life of the feedwater heater means per cycle from start to stop operations of the plant based on the setting value of the thermal stress, and calculating an allowable thermal stress value under a specific remaining working life of the feedwater heater means in accordance with the calculated remaining working life value.

11. A method of controlling a feedwater heater means as claimed in claim 9, wherein the step of calculating the feedwater temperature variation ratio is followed by a detecting of a feedwater temperature at an inlet side and outlet side of the feedwater heater means, calculating an actual feedwater temperature variation ratio based on the detecting feedwater temperature value, and calculating an allowable feedwater variation ratio based on the value of the allowable thermal stress, and calculating a feedwater temperature ratio deviation in accordance with both of the calculated feedwater temperature variation ratios.

12. A method of controlling a feedwater heater means as claimed in claim 9, wherein the step of controlling the extracting valve means is followed by detecting a temperature and pressure of an extracting steam, calculating an amount of the extracting steam to be introduced into the feedwater heater means based on the detecting value of the extracting steam, and calculating an operational signal for regulating the extracting valve means in accordance with the calculated value of the amount of the extracting steam.

13. A method of controlling at least one feedwater heater means in a steam turbine plant when the plant is starting and stopping, the method comprising the steps of:

setting an allowable thermal stress value of the feedwater heater means, calculating a remaining working life of the feedwater heater means under a condition of a predetermined thermal stress, calculating an allowable thermal stress value under a specific remaining working life of the feedwater heater means based on outputs of the calculated remaining working life and the set allowable thermal stress, calculating an allowable feedwater temperature variation ratio based on the value of the allowable thermal stress under a predetermined specific remaining working life, calculating an actual feedwater temperature variation ratio of the feedwater heater means, calculating a feedwater temperature ratio deviation in accordance with the calculated values of the feedwater temperature variation ratios, calculating an amount of the extracting steam to be introduced into the feedwater heater means based on the value of the calculated feedwater temperature ratio deviation and a condition of the extracting steam, and controlling an extracting valve in accordance with an output of the calculated amount of the extracted steam.

14. A method of controlling a feedwater heater means as claimed in claim 13, wherein the step of calculating the remaining working life of the feedwater heater means is followed by calculating a remaining working life in dependence upon a predetermined thermal stress per cycle from the start to stop operations of the turbine plant.

15. A method of controlling a feedwater heater as claimed in claim 4, wherein the step of calculating the actual feedwater temperature variation ratio of the feedwater heater means is followed by a detecting of feedwater temperature at an inlet and outlet side of the at least one feedwater heater means, and calculating an actual feedwater temperature variation based on the detected values of the feedwater temperature.

16. A method of controlling a feedwater heater means as claimed in claim 15, wherein the step of calculating the amount of the extracting steam is followed by detecting a temperature and a pressure of the extracting steam, and calculating an amount of the extracting steam to be introduced into the feedwater heater means in accordance with the values of the calculated feedwater temperature ratio deviation and the detected temperature and pressure of the extracting steam.

* * * * *